US008644734B2

(12) United States Patent
Cho

(10) Patent No.: US 8,644,734 B2
(45) Date of Patent: Feb. 4, 2014

(54) IMAGE FORMING APPARATUS AND METHOD FOR CONTROLLING THE SAME TO COMPENSATE FOR REGISTRATION ERRORS

(75) Inventor: Hyun-Ki Cho, Hanam-Si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 487 days.

(21) Appl. No.: 12/632,993

(22) Filed: Dec. 8, 2009

(65) Prior Publication Data

US 2010/0158569 A1 Jun. 24, 2010

(30) Foreign Application Priority Data

Dec. 24, 2008 (KR) ..... 10-2008-0133833

(51) Int. Cl.
*G03G 15/00* (2006.01)
*G03G 15/01* (2006.01)

(52) U.S. Cl.
USPC ..... 399/167; 399/126; 399/301

(58) Field of Classification Search
USPC ..... 399/167
See application file for complete search history.

(56) References Cited

U.S. PATENT DOCUMENTS

| | | | | |
|---|---|---|---|---|
| 7,769,330 | B2 * | 8/2010 | Kato et al. | 399/302 |
| 2006/0088338 | A1 * | 4/2006 | Matsuda et al. | 399/167 |
| 2006/0182465 | A1 * | 8/2006 | Funamoto et al. | 399/167 |
| 2007/0031166 | A1 * | 2/2007 | Zensai | 399/167 |
| 2007/0253735 | A1 * | 11/2007 | Sato | 399/167 |
| 2007/0258729 | A1 * | 11/2007 | Ehara et al. | 399/167 |

* cited by examiner

*Primary Examiner* — Walter L Lindsay, Jr.
*Assistant Examiner* — David Bolduc
(74) *Attorney, Agent, or Firm* — Staas & Halsey LLP

(57) ABSTRACT

An image forming apparatus may include one or more photosensitive media, a driving unit to rotate the photosensitive media, a detecting unit to detect a rotational state of each of the photosensitive media and a controller to control the driving unit based on the rotational state detected by the detecting unit so that two adjacent photosensitive media stop with a phase angle difference between them that is capable of compensating for image registration errors.

19 Claims, 7 Drawing Sheets

IMAGE FORMING APPARATUS AND METHOD FOR CONTROLLING THE SAME TO COMPENSATE FOR REGISTRATION ERRORS

CROSS-REFERENCE TO RELATED APPLICATIONS

This application claims the benefit under 35 U.S.C. §119 (a) from Korean Patent Application No. 2008-133833 filed Dec. 24, 2008 in the Korean Intellectual Property Office, the disclosure of which is incorporated herein by reference in its entirety.

TECHNICAL FIELD

The present disclosure relates generally to an image forming apparatus, and more particularly, to an image forming apparatus capable of forming color images using a plurality of photosensitive media and a method for controlling the same.

BACKGROUND

An image forming apparatus capable of forming color images may typically include four photosensitive media that may each form yellow images, magenta images, cyan images and black images, respectively. The four photosensitive media may generally be arranged in a row while a transfer medium may be disposed along side of the four photosensitive media so that each color image formed on each of the photosensitive media is sequentially superimposed onto the transfer medium, thereby forming a full color image.

In such an image forming apparatus, the accuracy of color registration, where each different color image is precisely superimposed onto the transfer medium, is important in order to obtain a high quality image. If the color images are not accurately superimposed, such misalignment between the images may be visibly noticeable, resulting in a poor impression of the quality of the full color image by a user.

To increase the accuracy of the color registration may require an increase in machining accuracies of various components, including the photosensitive media. However, to increase the machining accuracy of the photosensitive media may result in high expenses and also may be technically limiting. Therefore, other systems and methods to increase the accuracy of the color registration are desirable.

SUMMARY OF DISCLOSURE

According to one aspect of the present disclosure, there is provided an image forming apparatus that may include a plurality of photosensitive media, a driving unit, a detecting unit and a controller. The driving unit may be configured to rotate the plurality of photosensitive media. The detecting unit may be configured to detect a rotational state of each of the plurality of photosensitive media. The controller may be configured to control the driving unit based on the rotational state of each of the plurality of photosensitive media detected by the detecting unit, and may be configured control the driving member in such a mariner that two adjacent ones of the plurality of photosensitive media stop with a phase angle difference therebetween. The phase angle difference satisfying a formula:

$$\theta = q\frac{360(L-\pi L)}{\pi D},$$

where θ may represent the phase angle difference between the two adjacent photosensitive media, L may represent the distance between the two adjacent ones of the plurality of photosensitive media, and where D may represent the diameter of at least one of the plurality of photosensitive media.

The plurality of photosensitive media may comprise four photosensitive media arranged consecutively along an image transfer path. The controller may be configured to control the driving unit so that three photosensitive media located downstream of a first photosensitive medium in the image transfer path stops with the phase angle of θ, 2θ and 3θ, respectively, with respect to the first photosensitive medium.

The detecting unit may comprise a reference member and a detecting sensor. The reference member may be disposed on each of the plurality of photosensitive media. The detecting sensor may be configured to detect the reference member.

The reference member may comprises a projecting portion formed at a side surface of the photosensitive medium. The projecting portion may have an arc shape.

The reference member may be formed integrally with the photosensitive medium.

The image forming apparatus may further comprise a transfer mediating belt and a belt driving roller. An image formed on each of the plurality of photosensitive media may be transferred onto the transfer mediating belt. The belt driving roller may be configured to rotate the transfer mediating belt along a continuous loop.

The distance between the two adjacent ones of the plurality of photosensitive media may satisfies the relationship: $L=n\pi d$, where L is the distance between the two adjacent ones of the plurality of photosensitive media, d is the diameter of the belt driving roller, and n is an integer.

The transfer mediating belt may comprise one of an intermediate transfer belt onto which respective images on the plurality of photosensitive media are transferred and a printing medium conveying belt configured to convey a printing medium to each of the plurality of photosensitive media.

The controller may be configured to control the driving unit so that the two adjacent ones of the plurality of photosensitive media stop with the phase angle difference during a preparation for a printing operation.

According to another aspect of the present disclosure, there is provided a method of controlling an image forming apparatus. The method may comprise the steps of: determining whether to stop rotations of a plurality of photosensitive media; determining a rotational state of each of the photosensitive media if it is determined that the plurality of photosensitive media is to be stopped; and stopping the rotations of the plurality of photosensitive media so that each of the plurality of photosensitive media has a phase angle difference with respect to a first photosensitive medium located upstream of other ones of the plurality of photosensitive media. The phase angle difference may satisfy a relationship defined by:

$$\theta = q\frac{360(L-\pi D)}{\pi D},$$

where θ is the phase angle difference between two adjacent ones of the plurality of photosensitive media, L is the distance between the two adjacent ones of the plurality of photosensitive media, and where D is the diameter of a photosensitive medium.

The step of stopping the rotations of the plurality of photosensitive media may comprise: stopping a first one of the plurality of photosensitive media upon detection of a leading end of the reference member of the first one of the plurality of photosensitive media; and stopping each of other ones of the plurality of photosensitive media after elapse of a time duration after detection of a leading end of the reference member of that photosensitive medium, the photosensitive medium rotating by a rotational distance corresponding to the phase angle difference during the time duration.

According to yet another aspect of the present disclosure, there is provided an image forming apparatus that may have a plurality of photosensitive media arranged consecutively along an image transfer path. Each of the plurality of photosensitive media may be rotatable, and may be configured to come into contact with an image transfer medium in such a manner that the image transfer medium receives an image from each of the plurality of photosensitive media, The image forming apparatus may comprise a plurality of reference marks and a controller. The plurality of reference marks may each be arranged on a respective corresponding one of the plurality of photosensitive media. The controller may be configured to control the rotations of the plurality of photosensitive media in such a manner that the plurality of photosensitive media stop rotating at respective positions at which each of the plurality of reference marks has a predetermined angular phase difference with an adjacent one of the plurality of reference marks corresponding to an immediately adjacent one of the plurality of photosensitive media.

An angular phase difference between a first reference mark associated with a first one of the plurality of photosensitive media located most upstream with respect to a direction of movement of the image transfer medium and each of reference marks associated with remaining ones of the plurality of photosensitive media may satisfy a relationship defined by:

$$\theta = q\frac{360(L-\pi D)}{\pi D},$$

where θ is the predetermined angular phase difference between any two adjacent ones of the plurality of photosensitive media, L is a distance between two adjacent ones of the plurality of photosensitive media, D is a diameter of a photosensitive medium, and where q is an integer that represents an ordered position respectively of the remaining ones of the plurality of photosensitive media in an order from closest to furthest from the first one of the plurality of photosensitive media.

The image transfer medium may comprise a sheet of paper.

The image transfer medium may alternatively comprise an intermediate transfer belt arranged to rotate about a continuous loop in contact with each of the plurality of photosensitive media. The intermediate transfer belt may be supported on, and thereby receive a rotational force, from a belt driving roller.

A distance between two adjacent ones of the plurality of photosensitive media may satisfy a relationship defined by: $L=n\pi d$, where L is the distance between the two adjacent ones of the plurality of photosensitive media, d is the diameter of the belt driving roller, and where n is an integer.

Each of the plurality of photosensitive media may have having substantially a cylindrical roller shape with its length extending parallel to a rotational axis about which the photosensitive medium rotates. Each of the plurality of reference marks may comprise a projection protruding from a surface of an axial end of associated photosensitive medium. The projection may define an arc over a portion of the surface of the axial end.

The arc defined by any of the plurality of reference marks may be substantially concentric with a circumference of the corresponding one of the plurality of photosensitive media.

BRIEF DESCRIPTION OF THE DRAWINGS

Various features and advantages of the disclosure will become more apparent by the following detailed description of several embodiments thereof with reference to the attached drawings, of which.

DETAILED DESCRIPTION OF SEVERAL EMBODIMENTS

Figure 1:
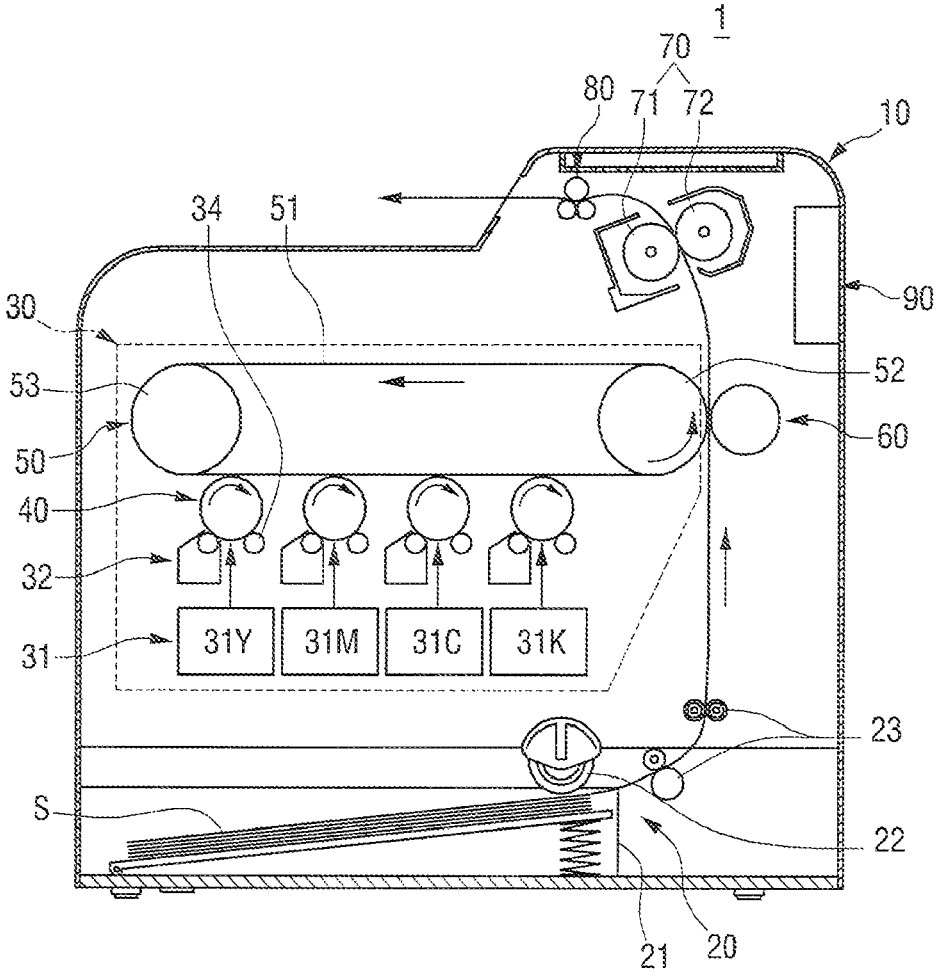
FIG. 1 is a sectional view schematically illustrating an image forming apparatus according to an embodiment.

Reference will now be made in detail to the embodiment, examples of which are illustrated in the accompanying drawings, wherein like reference numerals refer to like elements throughout. While the embodiments are described with detailed construction and elements to assist in a comprehensive understanding of the various applications and advantages of the embodiments, it should be apparent however that the embodiments can be carried out without those specifically detailed particulars. Also, well-known functions or constructions will not be described in detail so as to avoid obscuring the description with unnecessary detail. It should be also noted that in the drawings, the dimensions of the features are not intended to be to true scale and may be exaggerated for the sake of allowing greater understanding.

Figure 2:
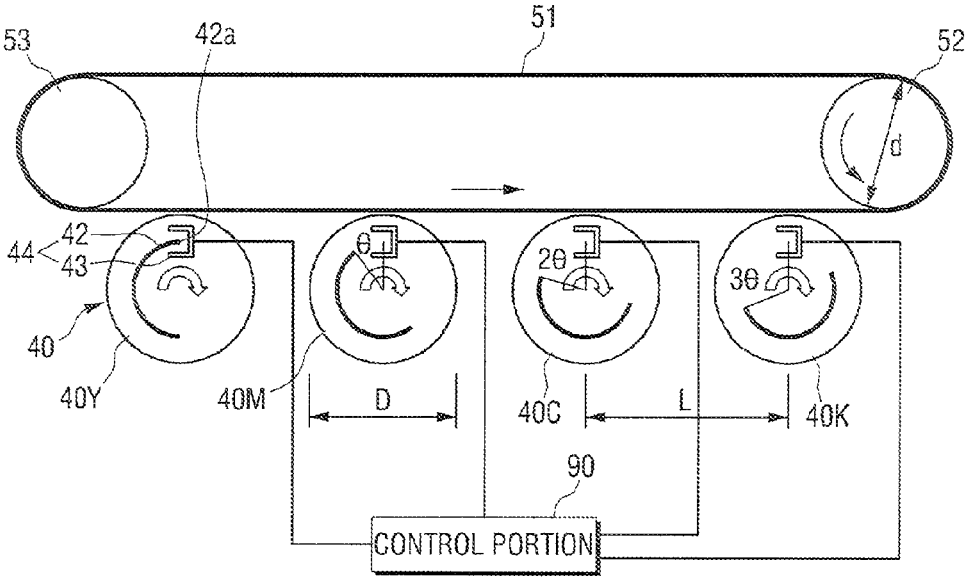
FIG. 2 is a partial view schematically illustrating a plurality of photosensitive media according to an embodiment.

FIG. 1 is a sectional view schematically illustrating an image forming apparatus according to an embodiment. FIG. 2 is a partial view schematically illustrating a plurality of photosensitive media of an image forming apparatus according to an embodiment.

Referring to FIG. 1, the image forming apparatus 1, according to an embodiment, may include a main body 10, a printing medium feeding unit 20, an image forming unit 30, a transfer roller 60, a fusing unit 70, a printing medium discharging unit 80 and a control portion 90.

The main body 10 may define the overall external structure of the image forming apparatus 1, and may support thereon various parts, devices, and/or components of the image forming apparatus 1, such as the printing medium feeding unit 20, the image forming unit 30, the transfer roller 60, the fusing unit 70, the printing medium discharging unit 80, and the control portion 90.

The printing medium feeding unit 20 may include a cassette 21 configured to store sheets of printing media S, a pickup roller 22 configured to pick up the printing media S stored in the cassette 21 one by one and a conveying roller 23 configured to convey the picked up printing medium S to the transfer roller 60.

The image forming unit 30 may form predetermined images corresponding to printing data, and may include a plurality of exposure units 31, a plurality of photosensitive media 40, a plurality of developing units 32 and a transfer mediating unit 50. In an embodiment, for forming full color images, the image forming unit 30 may include four exposure units 31, four photosensitive media 40 and four developing units 32. However, the number of each of the exposure units 31, photosensitive media 40, and developing units 32 is not limited to four. The image forming unit 30 may include any number of any of the exposure units 31, the photosensitive media 40 and the developing units 32.

Each of the plurality of exposure units 31Y, 31M, 31C and 31K may scan light corresponding to image information for one of yellow, magenta, cyan, and black colors to corresponding one of photosensitive media 40Y, 40M, 40C and 40K according to printing signals. The light scanned from each of the plurality of exposure units 31Y, 31M, 31C and 31K forms an electrostatic latent image on the corresponding one of the photosensitive media 40Y, 40M, 40C and 40K.

The plurality of developing units 32 may have received therein different color developers, for example, yellow developer, magenta developer, cyan developer and black developer, respectively. Each of the developing units 32 may include a developing member and a developer storing chamber.

Each developing member may be rotatably disposed to face the corresponding photosensitive medium 40, and may be configured to supply the photosensitive medium 40 with developer stored in the developer storing chamber, thereby developing an electrostatic latent image formed on the photosensitive medium 40 into a developer image. The developer storing chamber may store a predetermined amount of developer. A developer supplying roller, configured to supply developer to the developing member, and a developer agitating member, configured to agitate the developer, may also be disposed inside the developer storing chamber.

Each of the plurality of photosensitive media 40 may be charged to a predetermined bias by a corresponding charging member 34 disposed at a side thereof. An electrostatic latent image may be formed on each of the photosensitive media 40 by exposure to the light scanned from the corresponding exposure unit 31. Each of the plurality of photosensitive media 40 may be formed, in a cylindrical shape, for example, and may be rotated by power transmitted from a driving member (not illustrated). The driving member may include a motor as a driving source and at least one gear for transmitting power of the motor to the photosensitive media 40. The plurality of photosensitive media 40 may alternatively be configured so that each of the photosensitive media 40 is independently driven by a separate driving source.

The photosensitive media 40 may be machined for improving the accuracy of color registration. The plurality of photosensitive media 40Y, 40M, 40C and 40K for forming yellow, magenta, cyan and black color images, respectively, may be molded using the same mold, for example. If the plurality of photosensitive media 40Y, 40M, 40C and 40K are formed by the same mold, the photosensitive media 40Y, 40M, 40C and 40K may have the same or similar imperfections that may lead to the same or similar errors. For example, each may be formed with the same or similar runout error. When phase angles of the plurality of photosensitive media 40Y, 40M, 40C and 40K manufactured with the same mold are synchronized by a method as described below, the color registration error caused by the runout error may be reduced.

Figure 3:
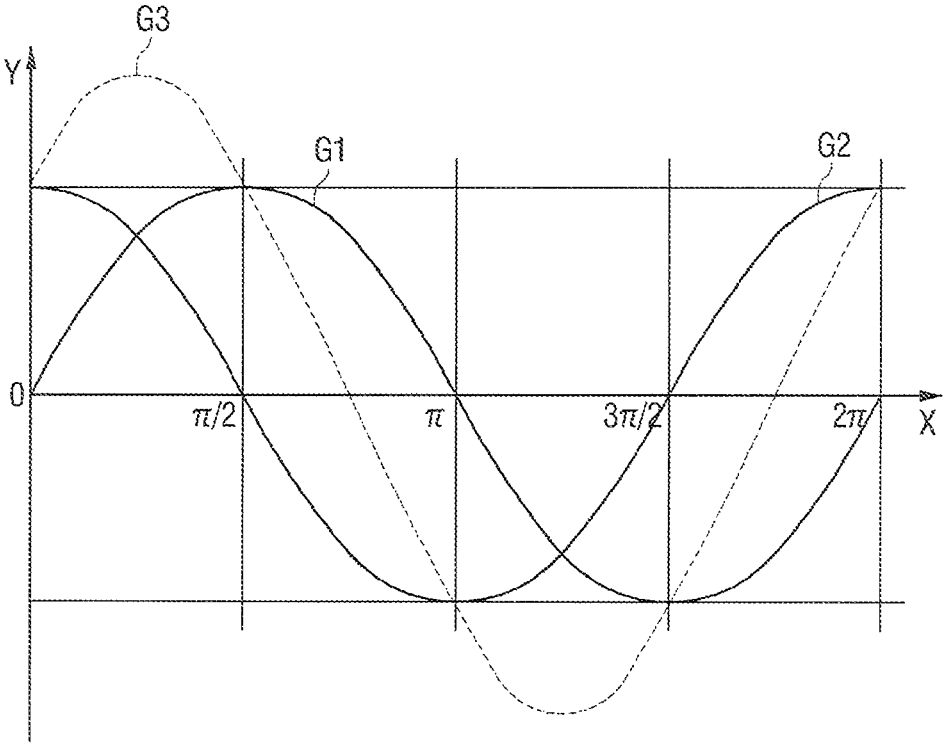
FIG. 3 is a graph illustrating a linear speed change of the photosensitive media of FIG. 1.

In general, when a photosensitive medium 40 of a cylindrical shape is formed with a runout error, the runout error occurs periodically according to the rotation of the photosensitive medium 40, and forms a sinusoidal wave. Therefore, even if the photosensitive medium 40 is rotated at a constant speed by the driving member, the linear speed of the surface of the photosensitive medium 40 may periodically change to form a sinusoidal wave due to the runout error. For example, while the photosensitive medium 40 rotates one turn, the linear speed of the surface of the photosensitive medium 40, as illustrated in FIG. 3, may change substantially following a sine wave. If the photosensitive medium 40 continues to rotate, the sine wave may be periodically repeated. Hereinafter, the wave generated by the linear speed change of the surface of the photosensitive medium 40 is referred to as a linear speed wave of the photosensitive medium 40.

The plurality of photosensitive media 40Y, 40M, 40C and 40K, as illustrated in FIGS. 1 and 2, may be arranged at regular intervals along a transfer mediating belt 51 of the transfer mediating unit 50. In an embodiment, four photosensitive media 40Y, 40M, 40C and 40K may be arranged at regular intervals L along the intermediate transfer belt 51. If the four photosensitive media 40Y, 40M, 40C and 40K are manufactured from the same mold, have the same or similar runout error, and rotate at the same rotation speed, the linear speed at which each transfers a developer image onto the intermediate transfer belt may be different from one another. When a photosensitive medium 40 transfers an image onto the intermediate transfer belt 51, the linear speed of the photosensitive medium 40 changes, and the position of the intermediate transfer belt 51 onto which the image is transferred may change. Therefore, when the four photosensitive media 40Y, 40M, 40C and 40K transfer images onto the intermediate transfer belt, the linear speeds of the four photosensitive media 40Y, 40M, 40C and 40K may become different from one another, and the color registration error may occur in the resultant full color image formed by superimposing each color developer image formed on a corresponding one of the four photosensitive media 40Y, 40M, 40C and 40K.

Such phenomenon may occur when phases of linear speed waves caused by the runout errors of the four photosensitive media 40Y, 40M, 40C and 40K are not the same as, or matched with, one another. For example, referring to FIG. 3, the graph G1 may represent the linear speed wave of the cyan photosensitive medium 40C on which a cyan developer image is formed while the graph G2 may represent the linear speed wave of the black photosensitive medium 40K on which a black developer image is formed. When, for example, the linear speed waves of the cyan photosensitive medium 40C and the black photosensitive medium 40K have a phase difference of approximate 90 degrees, the linear speed difference therebetween may be at its maximum. With the maximum linear speed difference, the color registration error of an image formed by superimposing of developer images formed on the black photosensitive medium 40K and the cyan photosensitive medium 40C may be at its maximum.

The phases of the linear speed waves of the plurality of photosensitive media 40Y, 40M, 40C and 40K may be matched with one another so that the color registration error caused by the phase difference of the linear speed waves of the photosensitive media 40 may be minimized. The linear speed wave is generated by the runout error of the photosensitive medium 40. If start points of the runout errors of the plurality of photosensitive media 40Y, 40M, 40C and 40K are matched with one another, the phases of the linear speed waves of the photosensitive media 40Y, 40M, 40C and 40K may also be matched.

A reference point may be established for each of the photosensitive media 40 as the start point of the runout error, and each of the images superimposed upon one another may be formed at the same position from the reference point of corresponding one of the plurality of photosensitive media 40. When the linear speed wave of the photosensitive medium 40 caused by a runout error is represented as a sine wave as illustrated in FIG. 3, a point along the X-axis, which represents the rotational angles of the photosensitive medium 40, may be determined as the reference point of the photosensitive medium 40. For example, if the reference point of photosensitive medium 40Y is set at a point corresponding to a position of "0" in FIG. 3, the reference point of each of the other photosensitive media 40M, 40C and 40K may be set at the point corresponding to the position of "0" in FIG. 3. Then, the runout error, and the linear speed, may be the same or almost same at the reference point of each of the plurality of photosensitive media 40Y, 40M, 40C and 40K. If the plurality of photosensitive media 40Y, 40M, 40C and 40K have the same reference point, and if they start their rotation at the same time from the reference point to rotate at the same rotational speed, variations of the runout errors, and accordingly variations of the linear speeds of the plurality of photosensitive media 40Y, 40M, 40C and 40K, may be almost the same as each other.

Various methods may be used for establishing the reference point at the same position of each of the plurality of photosensitive media 40Y, 40M, 40C and 40K. For example, according to an embodiment as illustrated in FIG. 2, a reference member 42 may be formed on a side surface of the photosensitive medium 40Y, and a leading end 42*a* of the reference member 42 may be used as the reference point. If the plurality of photosensitive media 40Y, 40M, 40C and 40K is molded from one mold that forms both the photosensitive medium 40 and the reference member 42 as a single body, the reference points of the plurality of photosensitive media 40Y, 40M, 40C and 40K may be formed approximately the same as one another.

A reference member 42 of a photosensitive medium 40 may be formed in a shape that a control portion 90 may be configured to detect using, for example, a detecting sensor 43. According to an embodiment, as illustrated in FIG. 2, the reference member 42 may be formed as a projection having an arc shape on a side surface of the photosensitive medium 40. According to an embodiment, the projecting portion 42 may be formed to have a length that is sufficient for detection of the rotational angle of the photosensitive medium 40 of approximate 170 degrees. However, the length of the projecting portion 42 may be longer or shorter, as desired. Also, the shape of the reference member 42 is not limited to the arc shaped projection. For example, according to an embodiment, the reference member 42 may be formed as a groove of a circular arc shape or some other shape that allows a detection of the reference point of the photosensitive medium 40 using, for example, the detecting sensor 43.

The detecting sensor 43 for detecting the reference member 42 may be disposed at a side of the reference member 42 of the photosensitive medium 40. Any type of a sensor capable of detecting the reference member 42 may be employed as the detecting sensor 43. For example, a photo sensor may be used as the detecting sensor 43. The detecting sensor 43 may be configured to, upon detecting the reference member 42 of the photosensitive medium 40, send a reference member detecting signal to the control portion 90.

Figure 4:
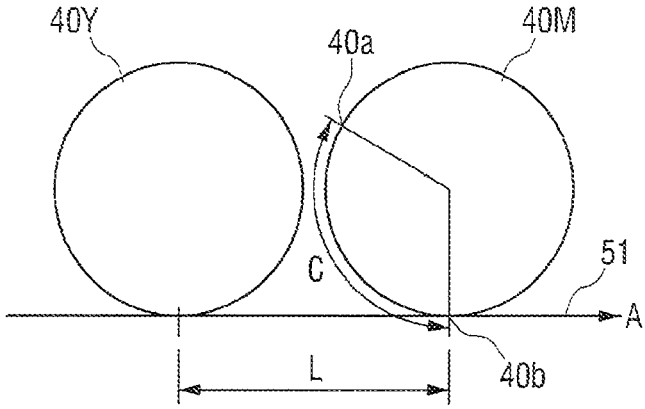
FIG. 4 is a view illustrating two adjacent photosensitive media according to an embodiment.

Therefore, when the plurality of photosensitive media 40Y, 40M, 40C and 40K have the same or almost the same runout error, each of the plurality of photosensitive media 40Y, 40M, 40C and 40K may be arranged to transfer an image from the same position from the reference point thereof onto the intermediate transfer belt so that the accuracy of the color registration of the image formed by the plurality of photosensitive media 40Y, 40M, 40C and 40K may be increased. As illustrated in FIG. 4, a distance C by which the reference point of the photosensitive medium 40M located downstream in the printing direction (arrow A) between two adjacent photosensitive media 40Y and 40M is spaced apart from a transferring point from which an image on the photosensitive medium 40M is transferred onto the intermediate transfer belt. Thus, the arc length C of the surface of the photosensitive medium 40M may be the same as the distance L between the two photosensitive media 40Y and 40M.

Referring again to FIG. 2, the distance L between the two adjacent photosensitive media 40C and 40K among the plurality of photosensitive media 40Y, 40M, 40C and 40K may be represented as a function of the diameter of the photosensitive medium 40, as expressed in Formula 1.

$$L=\pi D\pm s(\text{mm}) \qquad \text{Formula 1}$$

In Formula 1 above, L represents the distance between two adjacent photosensitive media 40. D is the diameter of the photosensitive medium 40, and s is the difference between the distance between the two adjacent photosensitive media 40 and the circumference of the photosensitive medium 40. s may be represented as a function of the circular arc length of the photosensitive medium 40, as expressed in Formula 2.

$$s=D\theta/2(\text{mm}) \qquad \text{Formula 2}$$

In Formula 2 above, D is the diameter of the photosensitive medium 40, and θ is the central angle of the circular arc of the photosensitive medium 40 having the length corresponding to the difference between the distance between the two adjacent photosensitive media 40 and the circumference of the photosensitive medium 40. Substituting Formula 2 into Formula 1 and manipulating the expression yields Formula 3 that represents the central angle of the circular arc of the photosensitive medium 40 as a relationship between the distance L between the two adjacent photosensitive media 40 and the diameter D of the photosensitive medium 40.

$$\theta = q\frac{2(L-\pi D)}{D}(\text{radian}) \qquad \text{Formula 3}$$

Converting units of the central angle of the circular arc θ from radian into degree yields Formula 4.

$$\theta = q\frac{360(L-\pi D)}{\pi D}(\text{degree}) \qquad \text{Formula 4}$$

Therefore, when a printing operation is performed from a state in that the plurality of photosensitive media 40Y, 40M, 40C and 40K arranged in a row stops and the reference points of two adjacent photosensitive media 40, as illustrated in FIG. 2, have a phase angle difference of θ, the images transferred onto the intermediate transfer belt by the two adjacent photosensitive media 40 may be superimposed with an increased color registration accuracy. When the image forming apparatus 1 has four photosensitive media 40Y, 40M, 40C and 40K arranged in a row as illustrated in FIG. 2, the reference points of the magenta photosensitive medium 40M, the cyan photosensitive medium 40C, and the black photosensitive medium 40K located downstream the yellow photosensitive medium 40Y may be disposed to stop with the phase angle difference of θ, 2θ, and 3θ with respect to the reference point of the yellow photosensitive medium 40Y, respectively, thereby increasing the accuracy of the color registration.

Figure 5:
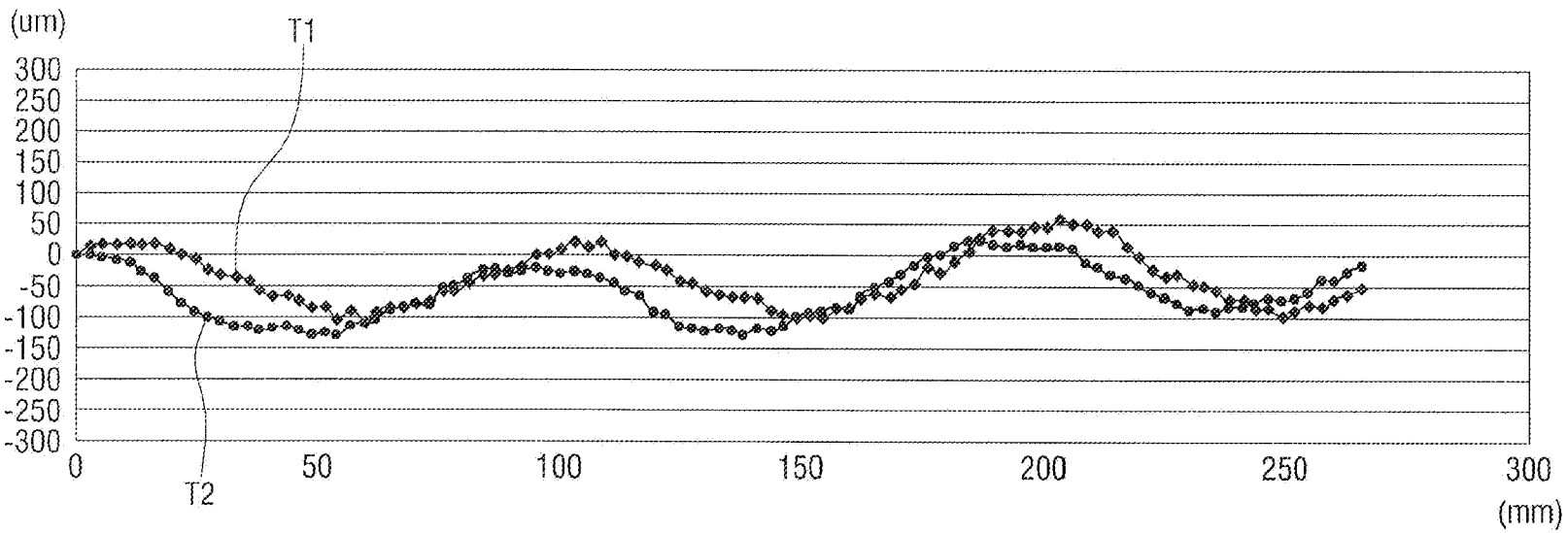
FIG. 5 is a graph illustrating color registrations of cyan color and black color in an image forming apparatus without a phase control.
Figure 6:
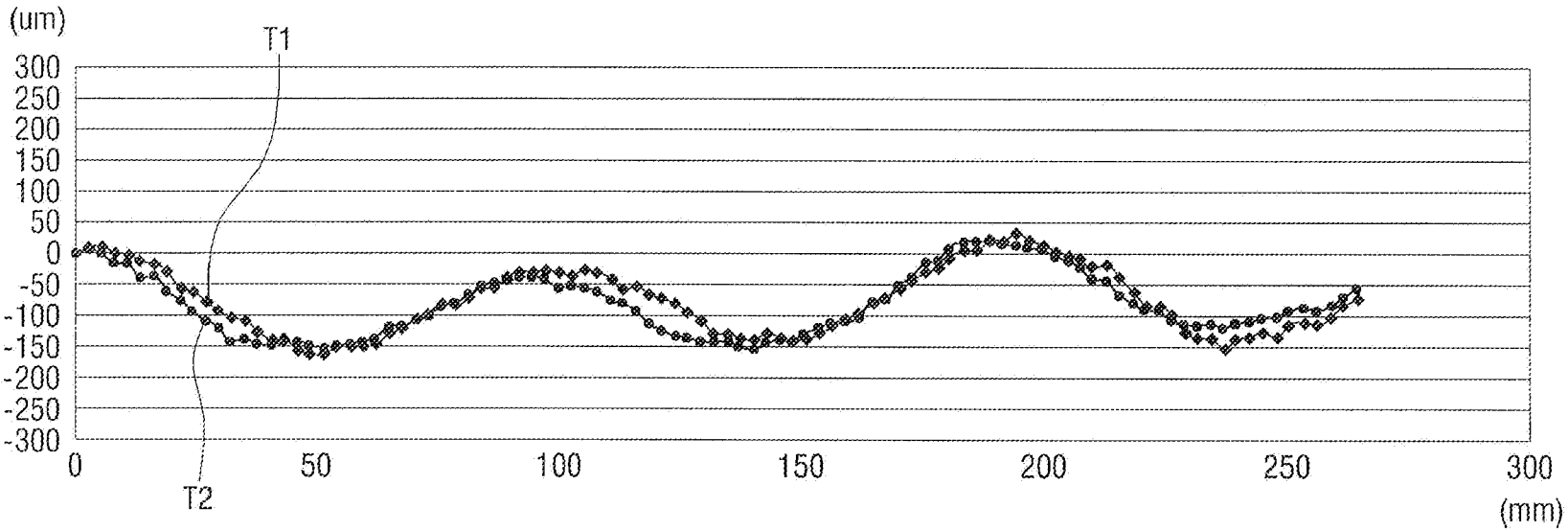
FIG. 6 is a graph illustrating color registrations of cyan color and black color in an image forming apparatus according to an embodiment.

FIGS. 5 and 6 illustrate test results when the reference points of the plurality of photosensitive media 40Y, 40M, 40C and 40K are synchronized according to an embodiment of the present disclosure and when they are not synchronized, for illustrative comparison purposes.

FIGS. 5 and 6 are graphs representing color registration errors of test patterns formed by the cyan photosensitive medium 40C and the black photosensitive medium 40K when printing the test patterns on a printing medium. FIG. 5 illustrates a case in which the cyan photosensitive medium 40C and the black photosensitive medium 40K perform a printing operation without the phase angle difference between the reference points thereof (i.e., they are not synchronized). FIG. 6 illustrates a case in which the cyan photosensitive medium 40C and the black photosensitive medium 40K perform a printing operation with the phase angle difference of θ between the reference points thereof (i.e., they are synchronized).

The test pattern is 100 straight lines of length of approximate 2.7 mm formed at regular intervals of approximate 0.1 mm. In FIGS. 5 and 6, the X-axis represents the length of the printing medium on which the test pattern is printed, and the Y-axis represents color deviations in a main scanning direction (i.e., errors of color registration). For the test patterns, the diameter of the photosensitive medium 40 is D=30 mm, the distance between the two photosensitive media 40 is L=104 mm, and the phase angle is θ=37.3.

When the phases of the cyan photosensitive medium 40C and the black photosensitive medium 40K are not synchronized, as illustrated in FIG. 5, there is a phase difference between the color deviations of the cyan color T1 and the black color T2 in the main scanning direction in the test pattern. However, when the phases of the cyan photosensitive medium 40C and the black photosensitive medium 40K are synchronized, as illustrated in FIG. 6, the color deviations of the cyan color T1 and the black color T2 in the main scanning direction in the test pattern have little phase deviation. Also, as illustrated in FIG. 5, when not synchronized, the error of the color registration is at an approximate maximum of 89 μm. However, when synchronized as illustrated in FIG. 6, the error of the color registration is decreased to an approximate maximum of 54 μm, improving the color registration error by approximately 40%.

Referring again to FIGS. 1 and 2. the transfer mediating unit 50 may be configured to cause developer images formed on four photosensitive media 40Y, 40M, 40C and 40K to be transferred onto a printing medium, and may include the transfer mediating belt 51, a belt driving roller 52 and a belt driven roller 53. In an embodiment, the intermediate transfer belt may be used as the transfer mediating belt 51, and developer images formed on the four photosensitive media 40Y, 40M, 40C and 40K may be directly transferred onto the surface thereof. However, the transfer mediating belt 51 is not limited by the intermediate transfer belt. Although not illustrated, a printing medium conveying belt for conveying printing media may be used as the transfer mediating belt 51. A printing medium conveying belt may be configured to convey the printing medium to the plurality of photosensitive media 40Y, 40M, 40C and 40K and may be configured to cause the images formed on the plurality of photosensitive media 40Y, 40M, 40C and 40K to be transferred directly onto the printing medium.

The transfer mediating belt 51 may be rotated along a continuous loop by the belt driving roller 52 and the belt driven roller 53. While the transfer mediating belt 51 is rotated by the belt driving roller 52 and the belt driven roller 53, the moving speed of the transfer mediating belt 51 may change periodically. If the moving speed of the transfer mediating belt 51 changes periodically, even though the phases of the plurality of photosensitive media 40Y, 40M, 40C and 40K are synchronized as described above, the color registration may worsen. The change of the moving speed of the transfer mediating belt 51 may result from, for example, the runout error of the belt driving roller 52. According to an embodiment, each of the plurality of photosensitive media 40Y, 40M, 40C and 40K may be disposed at a position corresponding to a distance of an integer-fold of the diameter of the belt driving roller 52 to reduce the color registration error caused by the periodical change of the moving speed of the transfer mediating belt 51. The plurality of photosensitive media 40Y, 40M, 40C, and 40K may be disposed so that the distance L between two adjacent photosensitive media 40 satisfies Formula 5.

$$L=n\pi d(\text{mm}) \qquad \text{Formula 5}$$

In Formula 5, n is an integer, and d is the diameter of the belt driving roller 52.

To improve the accuracy of color registration, the distance between the plurality of photosensitive media 40Y, 40M, 40C and 40K may be determined to correspond to the diameter of the belt driving roller 52, and the phases of the plurality of photosensitive media 40Y, 40M, 40C and 40K may be synchronized using the distance between the plurality of photosensitive media 40Y, 40M, 40C and 40K.

However, the change of the moving speed of the transfer mediating belt 52 may have a smaller effect on the accuracy of color registration than that of the phase angle difference between the plurality of photosensitive media 40Y, 40M, 40C and 40K. Therefore, according to an embodiment, the change of the moving speed of the transfer mediating belt 52 may not be considered.

The transfer roller 60 may be configured to rotate, and may face the transfer mediating belt 51. The transfer roller 60 may allow the color image formed on the transfer mediating belt 51 to be transferred onto the printing medium S conveyed from the printing medium feeding unit 20.

The fusing unit 70 may include a heat roller 71, which may include a heat source, and a pressure roller 72 disposed to face the heat roller 71. When the printing medium S, onto which the color images are transferred by the transfer roller 60, passes between the heat roller 71 and the pressure roller 72, the transferred images may be fixed on the printing medium S by the heat transmitted from the heat roller 71 and the pressure between the heat roller 71 and the pressure roller 72.

The printing medium discharging unit 80 may include a discharging roller and a discharging backup roller and may be configured to cause the printing medium S passing through the fusing unit 70 to be discharged outside the main body 10.

The control portion 90 may be configured to control the printing medium feeding unit 20, the image forming unit 30, the transfer roller 60, the fusing unit 70, and the printing medium discharging unit 80 to perform a printing operation. Methods by which the control portion 90 controls the above-described elements to perform a printing operation may be the same or similar as those of a conventional control portion; therefore, detailed descriptions thereof will be omitted.

When preparing a printing operation or when rotating and then stopping the plurality of photosensitive media 40 during a printing operation, the control portion 90 may be configured to control the two adjacent photosensitive media 40 to stop with the phase angle difference as described above so that the state in Formula 4 is satisfied. When power is applied to the image forming apparatus 1, the control portion 90 is configured to allow the plurality of photosensitive media 40 to rotate as a printing preparation process, and the control portion 90 may control each of the plurality of photosensitive media 40Y, 40M, 40C and 40K to stop with the phase angle difference of θ in order from the photosensitive medium 40Y, located at the most upstream in the printing direction. For example, as illustrated in FIGS. 1 and 2, when the image forming apparatus 1 has four photosensitive media 40Y, 40M, 40C and 40K, the control portion 90 may stop the Magenta photosensitive medium 40M with the phase angle difference of θ with respect to the yellow photosensitive medium 40Y, the cyan photosensitive medium 40C with the phase angle difference of θ with respect to the magenta photosensitive medium 40M (i.e., with the phase angle difference of 2θ with respect to the yellow photosensitive medium 40Y), and the black photosensitive medium 40K with the phase angle difference of θ with respect to the cyan photosensitive medium 40C (the phase angle difference of 3θ with respect to the yellow photosensitive medium 40Y). Then, when printing, images with a reduced error of the color registration may be obtained.

When the control portion 90 causes the plurality of photosensitive media 40Y, 40M, 40C and 40K to rotate, and then to stop, the control portion 90 may be configured to control each of the plurality of photosensitive media 40M, 40C and 40K to stop with the phase angle difference of θ with respect to the adjacent photosensitive media 40Y, 40M and 40C. If the plurality of photosensitive media 40Y, 40M, 40C and 40K stops with a predetermined phase angle difference, the images formed by the plurality of photosensitive media 40Y, 40M, 40C and 40K may be superimposed so as to improve the color registration.

The control portion 90 may be configured to utilize a detecting unit 44 disposed at each of the plurality of photosensitive media 40Y, 40M, 40C and 40K to detect the state of rotation of each of the plurality of photosensitive media 40Y, 40M, 40C and 40K. The detecting unit 44 may include a reference member 42 disposed at a side surface of the photosensitive medium 40 and a detecting sensor 43 disposed at a side of the photosensitive medium 40 to detect the reference member 42.

When the electric power is applied to the image forming apparatus 1, the control portion 90 may be configured to perform a printing preparing process. The control portion 90 may synchronize the reference points of the four photosensitive media 40Y, 40M, 40C and 40K and to stop the four photosensitive media 40Y, 40M, 40C and 40K.

The control portion 90 may be configured to detect a position of the reference member 42 of each of the four rotating photosensitive media 40Y, 40M, 40C and 40K using a corresponding one of the detecting sensors 43. When detecting the leading end 42*a* of the reference member 42 of the yellow photosensitive medium 40Y that is located at the most upstream side, the control portion 90 may control the driving member so that the leading end 42*a* of the reference member 42 corresponding to the reference point of the photosensitive medium 40Y is aligned with a sensing line of the detecting sensor 43. Upon the alignment of the leading end 42*a* of the reference member 42 with the sensing line of the detecting sensor 43, the yellow photosensitive medium 40Y may be stopped. Then, the control portion 90 may detect the leading end 42*a* of the reference member 42 of the magenta photosensitive medium 40M immediately next to the yellow photosensitive medium 40Y, cause the leading end 42*a* of the reference member 42 to further rotate to an angle of θ from the sensing line of the detecting sensor 43, and allow the magenta photosensitive medium 40M to stop. Next, the control portion 90 may control the cyan photosensitive medium 40C so that the leading end 42*a* of the reference member 42 of the cyan photosensitive medium 40C further rotates to an angle of 2θ from the sensing line of the detecting sensor 43, and then the cyan photosensitive medium 40C may stop. Finally, the control portion 90 may control the black photosensitive medium 40K so that the leading end 42*a* of the reference member 42 of the black photosensitive medium 40K further rotates to an angle of 3θ from the sensing line of the detecting sensor 43, and then the black photosensitive medium 40K may stop. As a result, the reference points of the magenta, cyan, and black photosensitive media 40M, 40C and 40K have the phase angle difference of θ, 2θ, and 3θ with respect to the reference point of the yellow photosensitive medium 40Y, respectively, so that the plurality of photosensitive media 40Y, 40M, 40C and 40K are synchronized.

Upon receiving a printing order or instruction and printing data from a host (not shown), the control portion 90 of the image forming apparatus 1 may be configured to control the printing medium feeding unit 20 to pickup a printing medium S and to feed the printing medium S between the transfer roller 60 and the transfer mediating belt 51 of the image forming unit 30.

At the same time or at an appropriate time in relation to the time of picking up the printing medium S, the control portion 90 may be configured to control the plurality of charging members 34 to charge the plurality of photosensitive media 40 to a predetermined voltage, and to control each of the plurality of exposure units 31 to scan light so as to form an electrostatic latent image corresponding to printing data for one of different colors on corresponding one of the plurality of photosensitive media 40.

Each of the plurality of developing units 32 may be configured to then supply a corresponding one of different color developers to a corresponding one of the photosensitive media 40 to develop an electrostatic latent image formed on the corresponding photosensitive medium 40 into a corresponding color developer image.

Different color developer images formed on the four photosensitive media 40 may be transferred to, and superimposed on, the intermediate transfer belt of the transfer mediating belt 51 to form a full color image. The transfer roller 60 may cause the color image formed on the intermediate transfer belt 51 to be transferred onto the printing medium S entering between the intermediate transfer belt 51 and the transfer roller 60.

While the printing medium S is passing through the fusing unit 70, the color image transferred onto the printing medium S may be fixed on the printing medium S by the heat and pressure of the fusing unit 70. The printing medium S having the color image fixed thereon may be discharged outside the main body 10 by the printing medium discharging unit 80.

When the control portion 90 causes at least one photosensitive medium 40 of the four photosensitive media 40 to rotate, and then to stop during the printing process as described above, the control portion 90 may allow the reference point of the corresponding photosensitive medium 40 to be synchronized, and may then allow the corresponding photosensitive medium 40 to stop.

While a detailed structure of the control portion 90 is not depicted in FIG. 1, as would be readily understood by those skilled in the art, the control portion 90 may be, e.g., a microprocessor, a microcontroller, or the like, that may include a central processing unit (CPU) to execute one or more computer instructions to implement the various control operations herein described and/or control operations relating to other components of the image forming apparatus, such as, for example, one or more of the print medium supply device 20, the exposure unit 31, the developing units 32, the transfer unit 60, the fusing unit 70 and the discharging unit 80, and to that end may further include a memory device, e.g., a Random Access Memory (RAM), Read-Only-Memory (ROM), a flesh memory, or the like, to store the one or more computer instructions.

Figure 7:
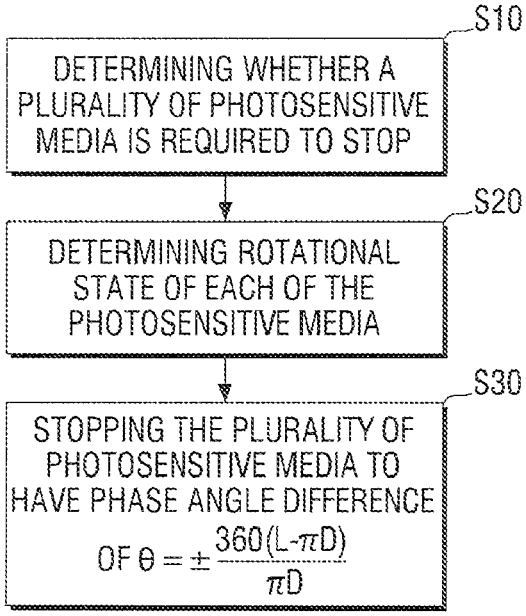
FIG. 7 is a flowchart illustrating a method for stopping a plurality of photosensitive media of an image forming apparatus according to an embodiment.

A method for controlling an image forming apparatus 1 according to an embodiment is explained with reference to accompanying FIGS. 1 and 7.

The control portion 90 may determine if it is necessary or desirable to stop the plurality of rotating photosensitive media 40 (S10).

If it is necessary or desirable to stop the plurality of rotating photosensitive media 40, as determined at S10, the control portion 90 may determine a rotational state of each of the plurality of photosensitive media 40 using the reference member 42 and the detecting sensor 43 of the corresponding photosensitive medium 40 (S20).

Next, the control portion 90 may stop each of the plurality of photosensitive media 40 using the reference member 42 and detecting sensor 43 of the photosensitive medium 40 so that each of the photosensitive medium 40 has the phase angle capable of satisfying Formula 4 as described above (S30). The control portion 90 may control the driving member of the photosensitive medium 40 using a point of time at which the leading end 42*a* of the reference member 42 passes the sensing line of the detecting sensor 43 so that each of the photosensitive media 40 stops with the phase angle as described above.

While the disclosure has been particularly shown and described with reference to several embodiments thereof with particular details, it will be apparent to one of ordinary skill in the art that various changes may be made to these embodiments without departing from the principles and spirit of the invention, the scope of which is defined in the following claims and their equivalents.

What is claimed is:

1. An image forming apparatus, comprising:

a plurality of photosensitive media;

a driving unit configured to rotate the plurality of photosensitive media;

a detecting unit configured to detect a rotational state of each of the plurality of photosensitive media; and a controller configured to control the driving unit based on the rotational state of each of the plurality of photosensitive media detected by the detecting unit, the controller being configured to control the driving member in such a manner that two adjacent ones of the plurality of photosensitive media stop with a phase angle difference therebetween, the phase angle difference satisfying a formula:

$$\theta = q\frac{360(L-\pi D)}{\pi D}$$

wherein θ is the phase angle difference between the two adjacent photosensitive media, L being the distance between the two adjacent ones of the plurality of photosensitive media, D being the diameter of at least one of the plurality of photosensitive media, and q being an integer that represents an ordered position respectively of the remaining ones of the plurality of photosensitive media in an order from closest to furthest from the first one of the plurality of photosensitive media, wherein the detecting unit comprises a reference member disposed on each of the plurality of photosensitive media, the reference member having an arc shape and having a length that is sufficient for detection of the rotational angle of the photosensitive media of 170 degrees, and wherein the reference member disposed on each of the plurality of photosensitive media corresponding to a start point of a same imperfection on each of the plurality of photosensitive media.

2. The image forming apparatus of claim 1, wherein the plurality of photosensitive media comprises four photosensitive media arranged consecutively along an image transfer path, and wherein the controller is configured to control the driving unit so that three photosensitive media located downstream of a first photosensitive medium in the image transfer path stops with the phase angle of θ, 2θ and 3θ, respectively, with respect to the first photosensitive medium.

3. The image forming apparatus of claim 1, wherein the detecting unit further comprises a detecting sensor configured to detect the reference member.

4. The image forming apparatus of claim 3, wherein the reference member comprises a projecting portion formed at a side surface of the photosensitive medium, the projecting portion having an arc shape.

5. The image forming apparatus of claim 3, wherein the reference member is formed integrally with the photosensitive medium.

6. The image forming apparatus of claim 1, further comprising:

a transfer mediating belt onto which an image formed on each of the plurality of photosensitive media is transferred;

a belt driving roller configured to rotate the transfer mediating belt along a continuous loop.

7. The image forming apparatus of claim 6, wherein the distance between the two adjacent ones of the plurality of photosensitive media satisfies a relationship, $$L=n\pi d,$$

wherein L is the distance between the two adjacent ones of the plurality of photosensitive media, d being the diameter of the belt driving roller, n being an integer.

8. The image forming apparatus of claim 6, wherein the transfer mediating belt comprises one of an intermediate transfer belt onto which respective images on the plurality of photosensitive media are transferred and a printing medium conveying belt configured to convey a printing medium to each of the plurality of photosensitive media.

9. The image forming apparatus of claim 1, wherein the controller is configured to control the driving unit so that the two adjacent ones of the plurality of photosensitive media stop with the phase angle difference during a preparation for a printing operation.

10. A method of controlling an image forming apparatus, comprising:

determining whether to stop rotations of a plurality of photosensitive media;

determining a rotational state of each of the photosensitive media if it is determined that the plurality of photosensitive media is to be stopped; and stopping the rotations of the plurality of photosensitive media so that each of the plurality of photosensitive media has a phase angle difference with respect to a first photosensitive medium located upstream of other ones of the plurality of photosensitive media, the phase angle difference satisfying a relationship defined by:

$$\theta = q\frac{360(L-\pi D)}{\pi D},$$

wherein θ is the phase angle difference between two adjacent ones of the plurality of photosensitive media, L being the distance between the two adjacent ones of the plurality of photosensitive media, D being the diameter of a photosensitive medium, and q being an integer that represents an ordered position respectively of the remaining ones of the plurality of photosensitive media in an order from closest to furthest from the first one of the plurality of photosensitive media, wherein each of the plurality of photosensitive media comprises a reference member having an arc shape and having a length that is sufficient for detection of the rotational angle of the photosensitive media of 170 degrees, and wherein the reference member disposed on each of the plurality of photosensitive media corresponding to a start point of a same imperfection on each of the plurality of photosensitive media.

11. The method of claim 10, wherein the plurality of photosensitive media comprises four photosensitive media arranged consecutively along an image transfer path, and wherein stopping the rotations of the plurality of photosensitive media comprises stopping the rotations so that three photosensitive media located downstream of a first photosensitive medium in the image transfer path stops with the phase angle of θ, 2θ and 3θ, respectively, with respect to the first photosensitive medium.

12. The method of claim 10, wherein the reference member for each of the plurality of photosensitive media comprising a projection having an arc shape and projecting from a side surface of the photosensitive medium.

13. The method of claim 12, wherein stopping the rotations of the plurality of photosensitive media comprises:

stopping a first one of the plurality of photosensitive media upon detection of a leading end of the reference member of the first one of the plurality of photosensitive media; and stopping each of other ones of the plurality of photosensitive media after elapse of a time duration after detection of a leading end of the reference member of that photosensitive medium, the photosensitive medium rotating by a rotational distance corresponding to the phase angle difference during the time duration.

14. An image forming apparatus having a plurality of photosensitive media arranged consecutively along an image transfer path, each of the plurality of photosensitive media being rotatable and being configured to come into contact with an image transfer medium in such a manner that the image transfer medium receives an image from each of the plurality of photosensitive media, the image forming apparatus comprising:

a plurality of reference marks each arranged on a respective corresponding one of the plurality of photosensitive media; and a controller configured to control rotations of the plurality of photosensitive media in such a manner that the plurality of photosensitive media stop rotating at respective positions at which each of the plurality of reference marks has a predetermined angular phase difference with an adjacent one of the plurality of reference marks corresponding to an immediately adjacent one of the plurality of photosensitive media, wherein an angular phase difference between a first reference mark associated with a first one of the plurality of photosensitive media located most upstream with respect to a direction of movement of the image transfer medium and each of reference marks associated with remaining ones of the plurality of photosensitive media satisfies a relationship defined by:

$$\theta = q\frac{360(L-\pi D)}{\pi D},$$

wherein θ is the predetermined angular phase difference between any two adjacent ones of the plurality of photosensitive media, L being a distance between two adjacent ones of the plurality of photosensitive media, D being a diameter of a photosensitive medium, q is an integer that represents an ordered position respectively of the remaining ones of the plurality of photosensitive media in an order from closest to furthest from the first one of the plurality of photosensitive media, wherein each of the plurality of reference marks has an arc shape and having a length that is sufficient for detection of the rotational angle of the photosensitive media of 170 degrees, and wherein the reference member disposed on each of the plurality of photosensitive media corresponding to a start point of a same imperfection on each of the plurality of photosensitive media.

15. The image forming apparatus of claim 14, wherein the image transfer medium comprises a sheet of paper.

16. The image forming apparatus of claim 14, wherein the image transfer medium comprises an intermediate transfer belt arranged to rotate about a continuous loop in contact with each of the plurality of photosensitive media, the intermediate transfer belt being supported on, and thereby receiving a rotational force, from a belt driving roller.

17. The image forming apparatus of claim 16, wherein a distance between two adjacent ones of the plurality of photosensitive media satisfies a relationship defined by:

$$L=n\pi d,$$

wherein L is the distance between the two adjacent ones of the plurality of photosensitive media, d being the diameter of the belt driving roller, n being an integer.

18. The image forming apparatus of claim 14, wherein each of the plurality of photosensitive media having substantially a cylindrical roller shape with its length extending parallel to a rotational axis about which the photosensitive medium rotates, and wherein each of the plurality of reference marks comprises a projection protruding from a surface of an axial end of associated photosensitive medium, the projection defining an arc over a portion of the surface of the axial end.

19. The image forming apparatus of claim 18, the arc defined by any of the plurality of reference marks being substantially concentric with a circumference of the corresponding one of the plurality of photosensitive media.

* * * * *